US009448529B2

(12) United States Patent
Shimizu

(10) Patent No.: US 9,448,529 B2
(45) Date of Patent: Sep. 20, 2016

(54) DEVELOPING CARTRIDGE

(71) Applicant: Brother Kogyo Kabushiki Kaisha, Nagoya-shi, Aichi-ken (JP)

(72) Inventor: Takashi Shimizu, Nagoya (JP)

(73) Assignee: Brother Kogyo Kabushiki Kaisha, Nagoya-shi, Aichi-Ken (JP)

( * ) Notice: Subject to any disclaimer, the term of this patent is extended or adjusted under 35 U.S.C. 154(b) by 0 days.

(21) Appl. No.: 14/546,710

(22) Filed: Nov. 18, 2014

(65) Prior Publication Data

US 2015/0139694 A1 May 21, 2015

(30) Foreign Application Priority Data

Nov. 18, 2013 (JP) ..... 2013-238350
Nov. 18, 2013 (JP) ..... 2013-238351

(51) Int. Cl.
*G03G 21/18* (2006.01)
*G03G 21/16* (2006.01)

(52) U.S. Cl.
CPC ..... *G03G 21/1676* (2013.01); *G03G 21/1647* (2013.01); *G03G 21/1821* (2013.01); *G03G 21/1853* (2013.01); *G03G 2221/1884* (2013.01)

(58) Field of Classification Search
CPC ..... G03G 21/185; G03G 21/1853; G03G 21/1847–21/1864
See application file for complete search history.

(56) References Cited

U.S. PATENT DOCUMENTS 6,208,817 B1 * 3/2001 Chadani ..... G03G 15/0942 399/104
6,625,413 B2 * 9/2003 Oguma ..... G03G 15/0896 222/DIG. 1
6,934,485 B2 * 8/2005 Miyabe ..... B29C 45/14467 399/106
7,450,877 B2 * 11/2008 Miyabe ..... G03G 21/1867 399/111
7,486,905 B2 * 2/2009 Nishimura ..... G03G 15/0894 399/106
7,761,024 B2 * 7/2010 Imaizumi ..... G03G 21/1871 399/112
8,254,807 B2 * 8/2012 Hayakawa ..... G03G 15/0896 399/119
2011/0038649 A1 * 2/2011 Miyabe ..... G03G 15/0896 399/119
2011/0158687 A1 6/2011 Mori
2013/0343777 A1 * 12/2013 Amann ..... G03G 15/0863 399/90

FOREIGN PATENT DOCUMENTS

JP 2011-133758 A 7/2011

* cited by examiner

*Primary Examiner* — Minh Phan
*Assistant Examiner* — Leon W Rhodes, Jr.
(74) *Attorney, Agent, or Firm* — Banner & Witcoff, Ltd.

(57) ABSTRACT

A developing cartridge, comprising: a housing; a developing roller; a drive mechanism configured to transmit a driving force to the developing roller; and a restriction part configured to restrict movement of the housing when the restriction part engages with an external member, wherein the housing comprises: a first side wall; and a second side wall spaced from the first side wall in a first direction, wherein the drive mechanism is disposed to the second side wall, wherein: the restriction part is disposed to the first side wall; and the restriction part comprises projecting parts spaced from each other in a second direction perpendicular to the first direction.

6 Claims, 10 Drawing Sheets

DEVELOPING CARTRIDGE

CROSS-REFERENCE TO RELATED APPLICATION

This application claims priority under 35 U.S.C. §119 from Japanese Patent Applications No. 2013-238350, filed on Nov. 18, 2013 and No. 2013-238351, filed on Nov. 18, 2013. The entire subject matter of the applications is incorporated herein by reference.

BACKGROUND

1. Technical Field

Aspects of the present invention relate to a developing cartridge attached to an image forming apparatus of an electrophotographic type.

2. Related Art

Conventionally, a developing cartridge attached to an image forming apparatus of an electrophotographic type is known. For example, the developing cartridge of this type includes a frame, a developing roller and a supply roller supported by the frame, and a driving unit which is disposed on a left side of the frame and is configured to transmit a driving force to the developing roller and the supply roller. The frame includes a developing roller support groove which supports both ends of the developing roller in the left and right direction.

For example, assembling of the developing cartridge is performed by attaching the supply roller to the frame in a state where a jig is inserted into the developing roller support groove to restrict movement of the frame, and by attaching the developing roller and the driving unit to the frame after removing the jig from the developing roller support groove.

SUMMARY

That is, in the above described assembling work of the developing cartridge, the developing roller support groove cannot be used to restrict movement of the frame after the developing roller is attached to the frame. Therefore, the assembling work of the developing cartridge tends to become unstable and troublesome.

Aspects of the present invention are advantageous in that they provide a developing cartridge capable of achieving smooth assembling work.

According to an aspect of the invention, there is provided a developing cartridge, comprising: a housing configured to store developer; a developing roller; a drive mechanism configured to transmit a driving force to the developing roller; and a restriction part configured to restrict movement of the housing when the restriction part engages with an external member. The housing comprises: a first side wall; and a second side wall disposed to face the first side wall while being spaced from the first side wall in a first direction in which a rotation axis of the developing roller extends. The drive mechanism is disposed to the second side wall. The restriction part is disposed to the first side wall. The restriction part comprises a pair of first projecting parts facing with each other while being spaced from each other in a second direction which is perpendicular to the first direction.

According to another aspect of the invention, there is provided a developing cartridge, comprising: a developing roller configured to be rotatable about a rotation axis extending in a first direction; a supply roller configured to be rotatable, to supply the developer to the developing roller and contacting the developing roller; and a housing configured to store the developer. The housing comprises: a first container unit configured to contain the developing roller and the supply roller; and a second container unit configured to store the developer therein and to be disposed adjacent to the first container unit on one side in a second direction which is perpendicular to the first direction. The housing further comprises: a pair of first walls disposed to be spaced from each other in the first direction; a second wall configured to connect the pair of first walls in the first direction; a conveying rib to protrude from the second wall to an outside of the housing, and configured to guide conveying of a recording medium; and a pair of engagement parts protruding from the second wall to the outside of the housing in a direction in which the conveying rib protrudes, and to restrict movement of the housing when the pair of engagement parts engage with an external member. The second wall extends in the second direction to form the first container unit and the second container unit. The pair of engagement parts are disposed closer to the second container unit in the second direction than a rotation center of the supply roller. A tip end of the conveying rib is positioned on an opposite side of an outer surface of the second wall with respect to each of tip ends of the pair of engagement parts.

BRIEF DESCRIPTION OF THE ACCOMPANYING DRAWINGS

DETAILED DESCRIPTION

Hereafter, an embodiment according to the invention will be described with reference to the accompanying drawings.

Outline of Developing Cartridge

Figure 1:
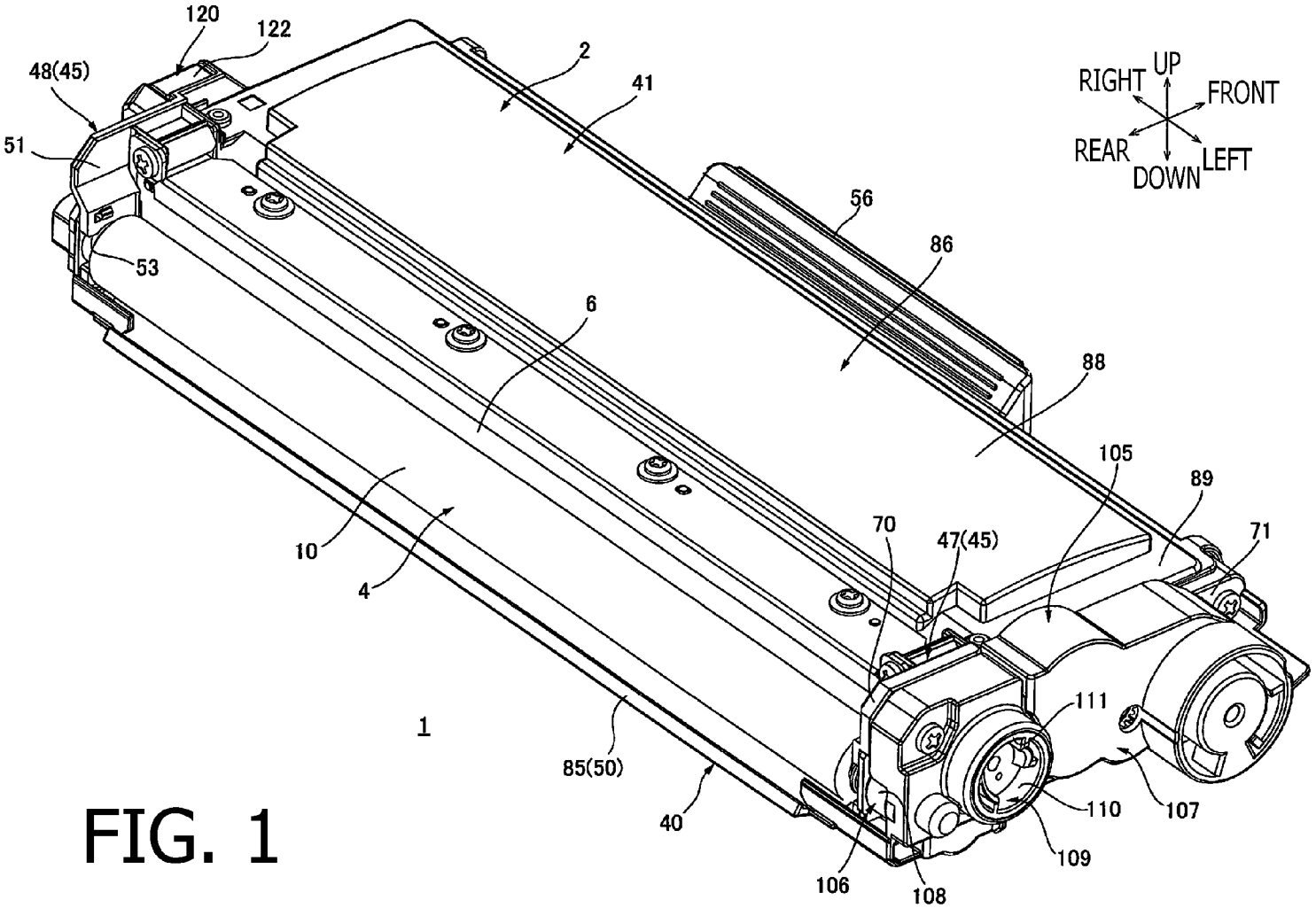
FIG. 1 is a perspective view of a developing cartridge according to an embodiment viewed from the upper left side.
Figure 5:
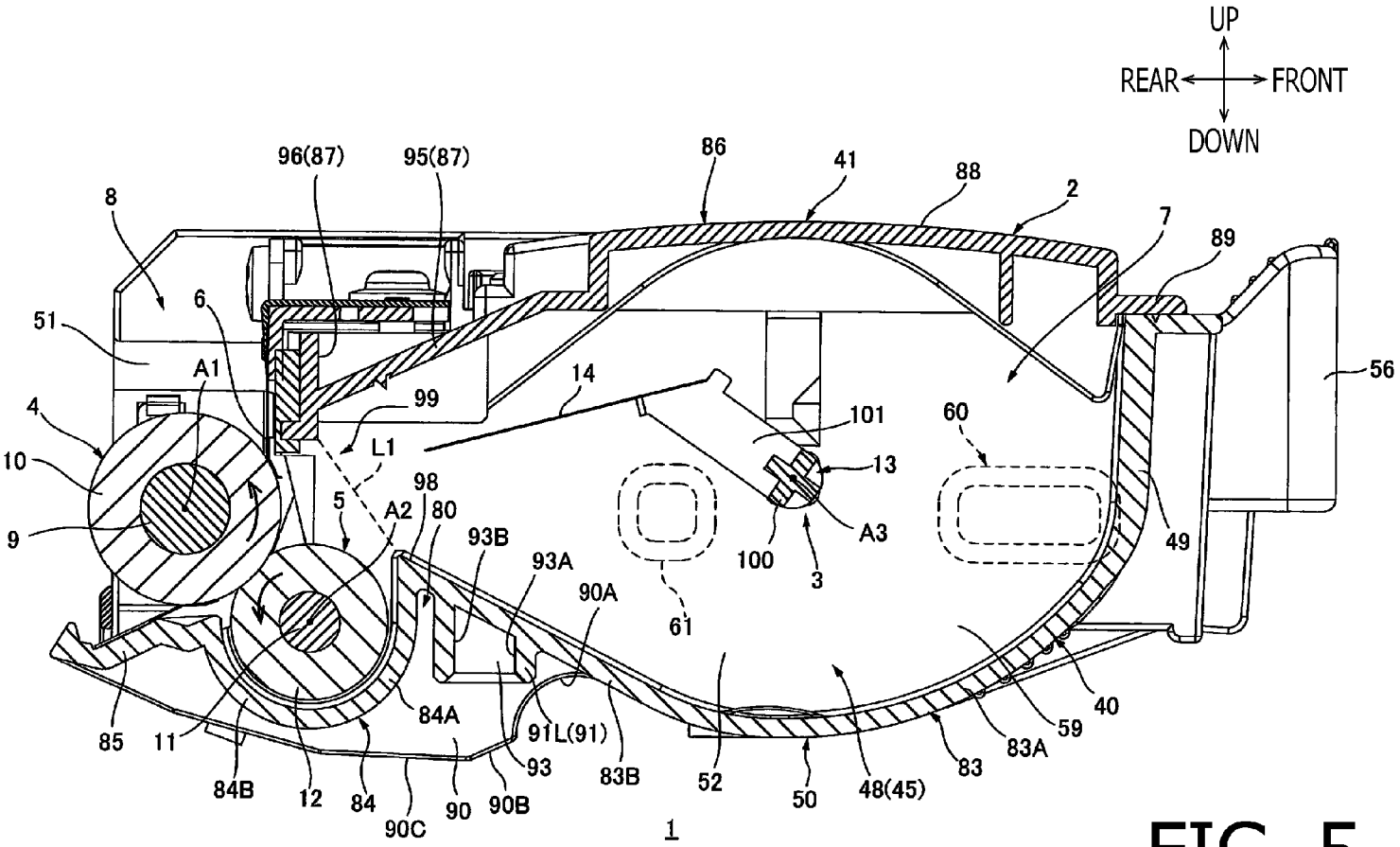
FIG. 5 is a cross sectional view of the developing cartridge cut along a line A-A shown in FIG. 4.

As shown in FIGS. 1 and 5, a developing cartridge 1 includes a housing 2, an agitator 3, a supply roller 5, a developing roller 4 and a layer thickness limit blade 6.

In the following explanation, when directions of the developing cartridge 1 is referred to, a side on which the developing roller 4 is disposed is defined as a rear side of the developing cartridge 1, and an opposite side of the rear side is defined as a front side of the developing cartridge 1. That is, the left side on the paper face of FIG. 5 is the rear side of the developing cartridge 1, and the right side on the paper face of FIG. 5 is the front side. Furthermore, the upper side on the paper face of FIG. 5 is an upper side of the developing cartridge 1, and the lower side on the paper face of FIG. 5 is the lower side of the developing cartridge 1. Left and right sides of the developing cartridge 1 are defined with reference to a state where the developing cartridge 1 is viewed from the front side. That is, the forehand side with respect to the paper face of FIG. 5 is the left side of the developing cartridge 1, and the back side with respect to the paper face of FIG. 5 is the right side of the developing cartridge 1. These sides are indicated specifically by arrows in the drawings.

As shown in FIG. 1, the housing 2 is formed in a box-shape extending in the left and right direction, and stores toner therein. The rear end part of the housing 2 is opened in the front and rear direction.

As shown in FIG. 5, the agitator 3 is disposed on the front portion in the housing 2. The supply roller 5 is disposed on the lower rear side of the agitator 3 in the housing 2, and is rotatably supported in the housing 2. The developing roller 4 is disposed on the upper rear side of the supply roller 5 and at the rear end portion of the housing 2. The lower front edge of the developing roller 4 is pressed against the upper rear edge of the supply roller 5. The upper part and the rear part of the developing roller 4 are exposed from the housing 2. The developing roller 4 is rotatably supported in the housing 2.

The layer thickness limit blade 6 is disposed on the upper front side of the developing roller 4. The lower edge of the layer thickness limit blade 6 contacts the front edge of the developing roller 4.

2. Overall Configuration of Printer

Figure 10:
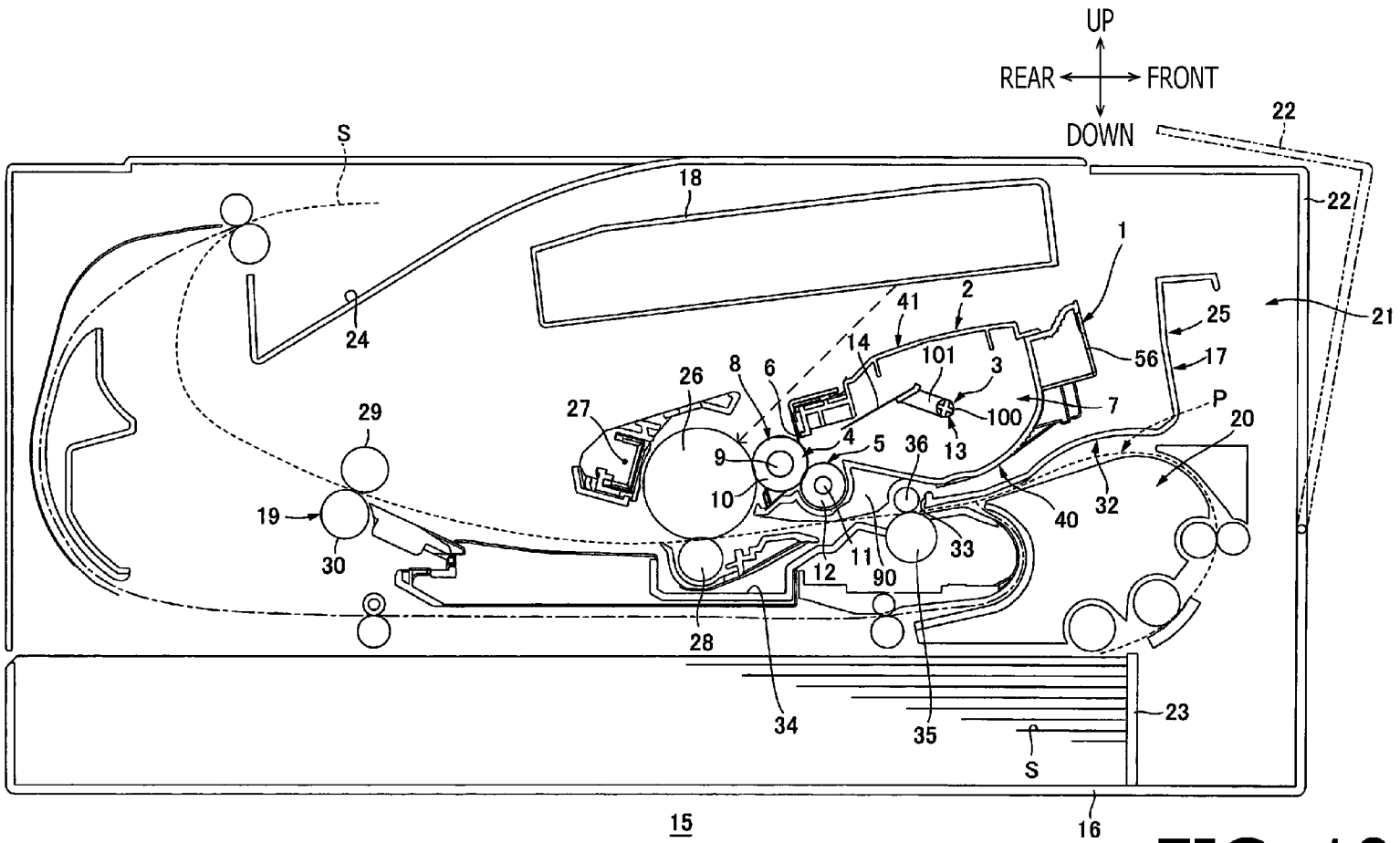
FIG. 10 is a central cross section of a printer provided with the developing cartridge shown in FIG. 1.

As shown in FIG. 10, the developing cartridge 1 is mounted on a printer 15. The printer 15 is a monochrome printer of an electrophotographic type. The printer 15 includes a main body casing 16, a process cartridge 17, a scanner unit 18, a fixing unit 19 and a paper conveying guide 20.

The main body casing 16 is formed in a box-shape. The main body casing 16 includes an opening 21, a front cover 22, a paper supply tray 23 and a discharge tray 24.

The opening 21 penetrates through a front wall of the main body casing 16 in the front and rear direction, and lets the process cartridge 17 to pass therethrough. The front cover 22 is a plate-like member formed in a letter of "L" when viewed as a side view. The front cover 22 is swingably supported by the front wall of the main body casing 16 around the lower end thereof acting as a fulcrum. The front cover 22 is configured to open or close the opening 21.

The paper supply tray 23 is disposed in the bottom portion of the main body casing 16. The paper supply tray 23 is configured to store therein recording media, such as sheets of paper S. The discharge tray 24 is disposed on the upper surface of the main body casing 16. The discharge tray 24 is formed to be recessed downward from the upper surface of the main body casing 16 so that the sheet of paper S is placed thereon.

The process cartridge 17 is detachably attachable to the main body casing 16 via the opening 21. The process cartridge 17 is disposed at the central portion in the up and down direction of the main body casing 16 in a state where the process cartridge 17 is attached to the main body casing 16. The process cartridge 17 includes a drum cartridge 25 and the above described developing cartridge 1.

The drum cartridge 25 includes a drum frame 32, a photosensitive drum 26, a scorotron charger 27, a transfer roller 28 and a pinch roller 36.

The drum frame 32 is a bottomed frame-like member having a rectangular shape when viewed as a plan view. A bottom wall of the drum frame 32 has a passing port 33. The passing port 33 is disposed at a central portion in the front and rear direction of the bottom wall of the drum frame 32. The passing port 33 has the shape and the size allowing the sheet of paper S to pass therethrough, and penetrates the bottom wall of the drum frame 32 in the up and down direction.

The photosensitive drum 26 is disposed at the rear edge portion of the drum cartridge 25, and has a cylindrical shape extending in the left and right direction. The photosensitive drum 26 is rotatably supported by the drum frame 32. The scorotron charger 27 is disposed on the rear side of the photosensitive drum 26 and is spaced from the photosensitive drum 26.

The transfer roller 28 is disposed on the lower side of the photosensitive drum 26. The transfer roller 28 contacts the lower edge of the photosensitive drum 28. The pinch roller 36 has a cylindrical shape extending in the left and right direction, and is disposed to adjoin to the front edge of the passing port 33 from the rear side. The pinch roller 36 is rotatably supported by the drum frame 32.

The developing cartridge 1 is configured to be detachably attachable to the drum frame 32. In the state where the developing cartridge 1 is attached to the drum frame 32, the rear edge of the developing roller 4 contacts the front edge of the photosensitive drum 26.

The scanner unit 18 is disposed on the upper side of the process cartridge 17. As shown by a dashed line in FIG. 10, the scanner unit 18 is configured to emit a laser beam based on image data to the photosensitive drum 26.

The fixing unit 19 is disposed on the rear side of the process cartridge 17 and is spaced from the process cartridge 17. The fixing unit 19 includes a heat roller 29 and a pressure roller 30. The pressure roller 30 is disposed on the lower rear side of the heat roller 29, and is pressed against the lower rear edge of the heat roller 29.

The paper conveying guide 20 is configured to guide the sheet of paper S to pass from the paper supply tray 23 to a position between the photosensitive drum 26 and the transfer roller 28, and to reach the fixing unit 19. The paper conveying guide 20 is disposed to extend in the front and rear direction in a portion between the process cartridge 17 and the paper supply tray 23 in the up and down direction. Further, the paper conveying guide 20 includes a groove 34 and a registration roller 35.

The groove 34 is disposed in a central portion in the front and rear direction of the paper conveying guide 20. The groove 34 has a rectangular shape when viewed as a side view, and is formed to be recessed downward from the upper surface of the paper conveying guide 20. Further, the groove 34 is formed to receive the lower rear edge part of the process cartridge 17 attached to the main body casing 16.

The registration roller 35 is disposed on the front side of the groove 34 and is spaced from the registration roller 35 and the groove 34. The registration roller 35 has a cylindrical shape extending in the left and right direction, and is rotatably supported by the paper conveying guide 20. Further, the upper edge of the registration roller 35 contacts the lower edge of the pinch roller 36 attached to the process cartridge 17.

The upper surface of the paper conveying guide 20 and a part of the bottom wall of the drum frame 32 on the front side of the passing port 33 define a conveying path P. The conveying path P is configured such that the sheet of paper S supplied from the paper supply tray 23 passes from the upper front side to the lower rear side while proceeding toward the space between the pinch roller 36 and the registration roller 35.

When image formation operation is started under control of a control unit (not shown) in the printer 15, the scorotron charger 27 charges uniformly the surface of the photosensitive drum 26. Thereafter, the scanner unit 18 exposes the surface of the photosensitive drum 26. As a result, an electrostatic latent image based on the image data is formed on the surface of the photosensitive drum 26.

The agitator 3 agitates the toner in the housing 2, and supplies the agitated toner to the supply roller 5. The supply roller 5 supplies the toner supplied from the agitator 3 to the developing roller 4. At this time, the toner is frictionally charged positively between the developing roller 4 and the supply roller 5, and is held on the developing roller 4. The layer thickness limit blade 6 limits the thickness of the toner held on the developing roller 4 to a constant value. Further, the developing roller 4 supplies the toner, which is held thereon in a constant thickness, to the surface of the photosensitive drum 26. As a result, a toner image is held on the surface of the photosensitive drum 26.

By rotations of the various rollers, the sheet of paper S is sent to the conveying path P from the paper supply tray 23. After passing through the conveying path P, the sheet of paper S is sent to the space between the photosensitive drum 26 and the transfer roller 28 one by one at predetermined timing while passing through the passing port 33. At this time, a conveying rib which is described later guides the sheet of paper S which has passed through the passing port 33 to proceed to the position between the photosensitive drum 26 and the transfer roller 28.

The toner image on the photosensitive drum 26 is transferred to the sheet of paper S when the sheet of paper S passes through the position between the photosensitive drum 26 and the transfer roller 28. Thereafter, the sheet of paper S heated and pressed when the sheet of paper S passes through the position between the heat roller 29 and the pressure roller 30. At this time, the tone image on the sheet of paper S is thermally fixed on the sheet of paper S. Then, the sheet of paper S is discharged to the discharge tray 24.

3. Details about Developing Cartridge

The housing 2 is made of resin, and includes a first frame 40 and a second frame 41.

(1) First Frame

Figure 3:
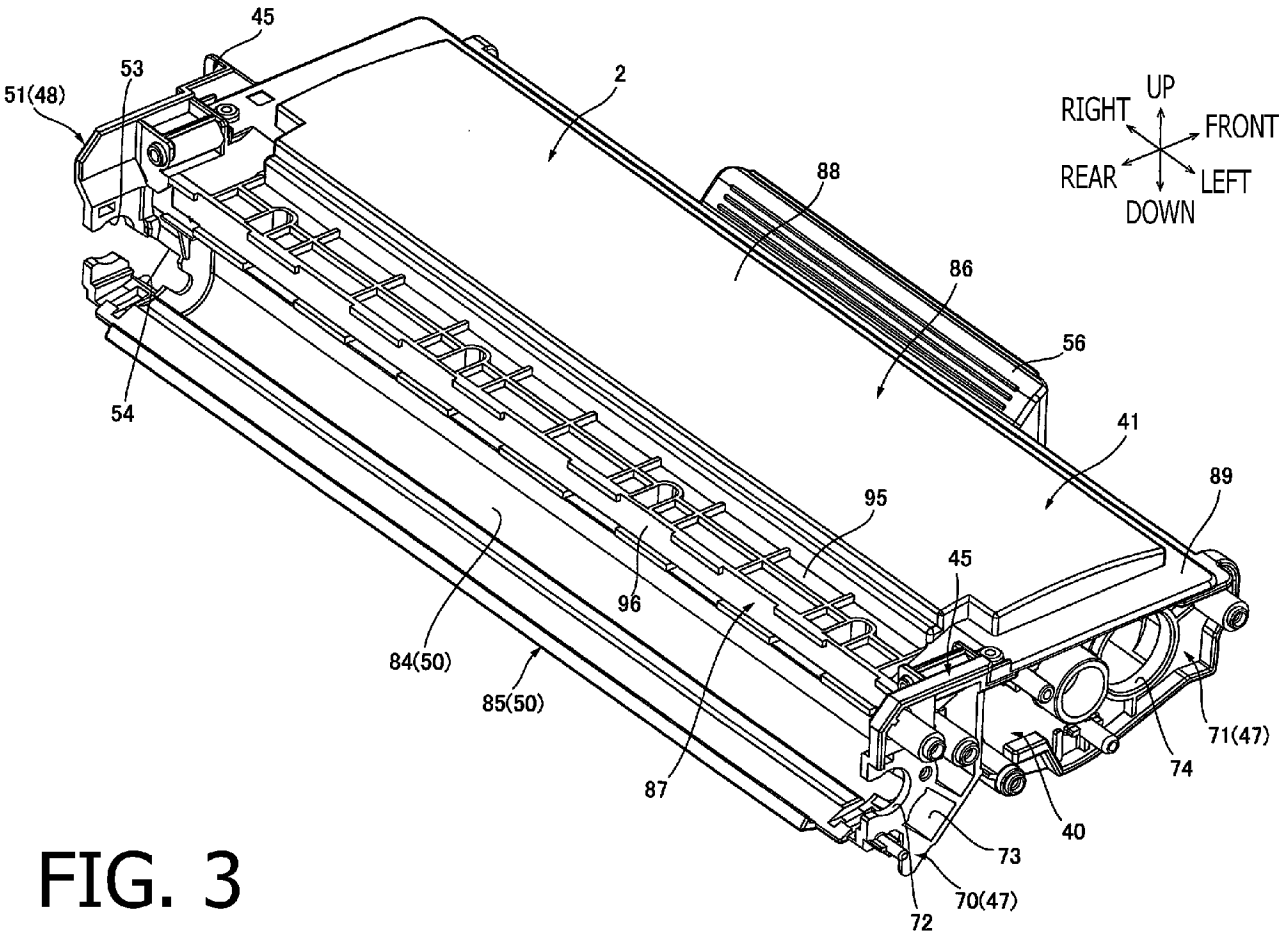
FIG. 3 is a perspective view of a housing shown in FIG. 1 viewed from the upper left side.

The first frame 40 forms a lower part of the housing 2. As shown in FIGS. 3 and 5, the first frame 40 includes a pair of side walls 45, a front wall 49 and a bottom wall 50.

The pair of side walls 45 are both edge parts of the first frame 40 in the left and right direction and are disposed to have an interval therebetween. Specifically, the pair of side walls 45 include a right side wall 48 and a left side wall 47.

Figure 6:
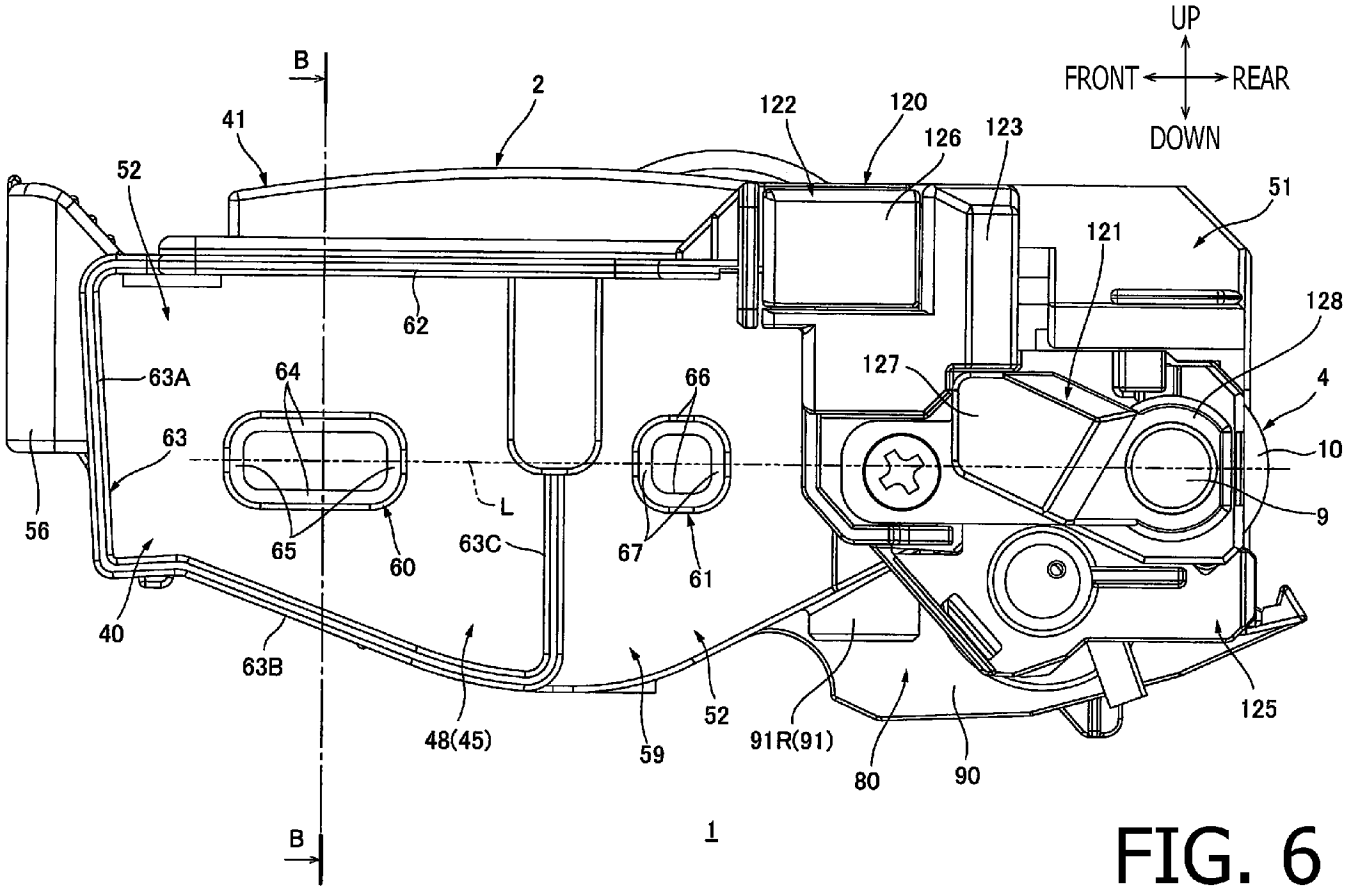
FIG. 6 is a right side view of the developing cartridge shown in FIG. 2.

As shown in FIG. 3, the right side wall 48 is a right edge part of the first frame 40. As shown in FIG. 6, the right side wall 48 is a plate-like member having a rectangular shape extending in the front and rear direction when viewed as a side view, and includes a developing chamber side wall 51 and a reservoir side wall 52 which are integrally provided.

The developing chamber side wall 51 is a rear part of the right side wall 48, and has a rectangular shape when viewed as a side view. As shown in FIG. 3, the developing chamber side wall 51 has a developing shaft insertion hole 53 and a supply shaft insertion hole 54.

The developing shaft insertion hole 53 has a shape of a letter "C" opened toward the rear side when viewed as a side view, and is recessed frontward from the center in the up and down direction of the rear edge of the developing chamber side wall 51. The supply shaft insertion hole 54 is disposed on the lower front side with respect to the developing shaft insertion hole 53. The supply shaft insertion hole 54 has a rectangular shape when viewed as a side view, and is formed to penetrate the developing chamber side wall 51 in the left and right direction. Further, the developing shaft insertion hole 53 and the supply shaft insertion hole 54 are formed to communicate with each other in a direction connecting from the lower front side to the upper rear side.

As shown in FIG. 6, the reservoir side wall 52 is a front part of the right side wall 48, and has a rectangular shape extending in the front and rear direction when viewed as a side view. The reservoir side wall 52 includes a main body 59, a welding part 62, a reinforcement rib 63, a first restriction part 60 and a second restriction part 61, which are integrally provided.

Figure 7:
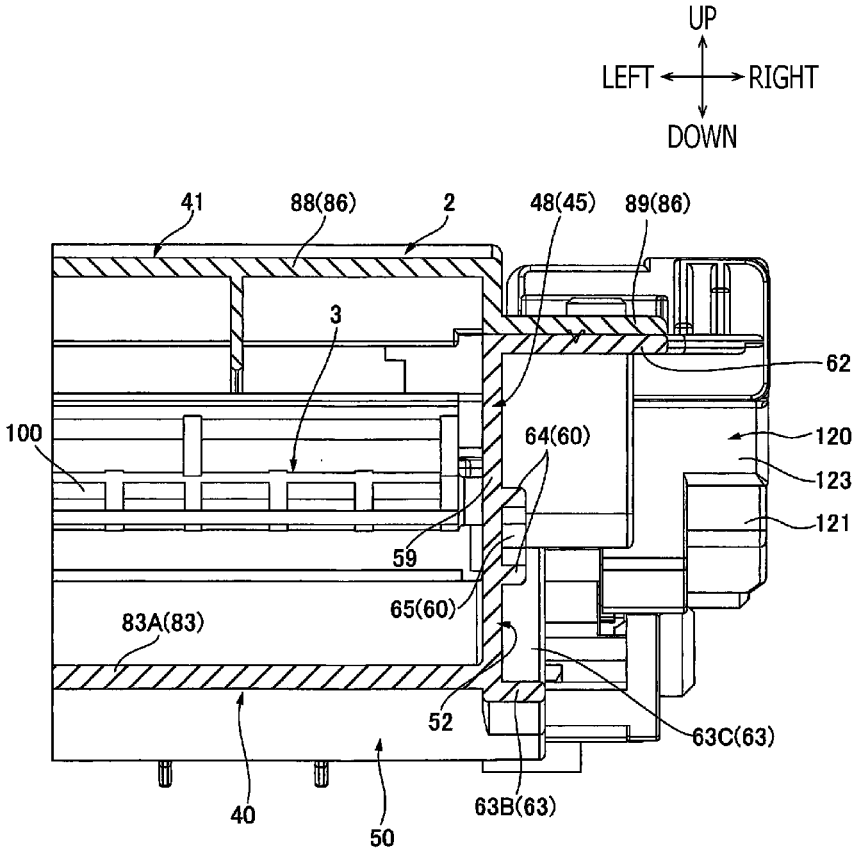
FIG. 7 is a cross sectional view of the developing cartridge cut along a line B-B shown in FIG. 6.

The main body 59 is a plate-like member having a rectangular shape extending in the front and rear direction when viewed as a side view, and is formed to extend continuously from the front edge of the developing chamber side wall 51 to the front side. As shown in FIG. 7, the welding part 62 protrudes from the upper edge of the main body 59, and, as shown in FIG. 6, extends over the entire main body 59 in the front and rear direction.

The reinforcement rib 63 is disposed on the right surface of the main body 59, and has a U-shape opened toward the upper side when viewed as a side view. The reinforcement rib 63 is formed to reinforce the right side wall 48, and includes a front part 63A, a lower part 63B and a rear part 63C.

The front part 63A protrudes rightward from the front edge of the main body 59, and extends from the front edge of the welding part 62 to the lower edge of the main body 59 along the front edge of the main body 59. The lower part 63B protrudes rightward from the lower edge of the main body 59, and continuously extends from the lower edge of the front part 63A to the central part in the front and rear direction along the lower edge of the main body 59. The rear part 63C protrudes rightward from the central part in the front and rear direction of the main body 59, and continuously extends to the upper side from the rear edge of the lower part 63B to the central part of the main body 59 when viewed as a side view. As shown in FIG. 7, the size of the reinforcement rib 63 in the left and right direction is smaller than the size of the welding part 62 in the left and right direction.

The first restriction part 60 is exposed when viewed from the right side, and is disposed in the front part of the right surface of the main body 59 such that the first restriction part 60 is surrounded by the wielding part 62 and the reinforcement rib 63 when viewed as a right side view. Specifically, the first restriction part 60 is disposed on a lower side with respect to the welding part 62 to be spaced from the welding part 62, is disposed on the rear side with respect to the front part 63A of the reinforcement rib 63 to be spaced from the lower part 63B, is disposed on the upper side with respect to the lower part 63B of the reinforcement rib 63 to be spaced from the lower part 63B, and is disposed on the front side with respect to the rear part 63C of the reinforcement rib 63 to be spaced from the rear part 63C.

The first restriction part 60 has a rectangular ringed shape extending in the front and rear direction when viewed in the left and right direction, and protrudes rightward from the right surface of the main body 59. As shown in FIG. 7, the size in the left and right direction of the first restriction part 60 is smaller than the size in the left and right direction of the reinforcement rib 63. That is, the right edge of the reinforcement rib 63 is disposed on the outside (i.e., on the right side) in the left and right direction relative to the right edge of the first restriction part 60.

As shown in FIG. 6, the first restriction part 60 includes a pair of first restriction walls 65 and a pair of second restriction walls 64. The pair of first restriction walls 65 are disposed to face with each other in the front and rear direction to have an interval therebetween. The first restriction walls 65 linearly extend in the up and down direction when viewed as a side view.

The second restriction walls 64 are disposed to face with each other to have an interval therebetween. The second restriction walls 64 linearly extend in the front and rear direction when viewed as a side view. Of the pair of second restriction walls 64, the upper second restriction wall 64 connects the upper edges of the pair of first restriction walls 65 in the front and rear direction, and the lower second restriction wall 64 connects the lower edges of the pair of first restriction walls 65 in the front and rear direction.

The second restriction part 61 is exposed when viewed from the right side, and is disposed on the rear side on the right surface of the main body 59 such that the second restriction part 61 is disposed on an opposite side of the first restriction part 60 with respect to the rear part 63C of the reinforcement rib 63. Further, the second restriction part 61 is disposed to overlap with the first restriction part 60 when viewed in the front and rear direction.

The second restriction part 61 has a rectangular ringed shape when viewed in the left and right direction, and protrudes rightward from the right surface of the main body 59. That is, the first restriction part 60 and the second restriction part 61 are disposed on the right side of the right side wall 48 which is disposed on the opposite side with respect to the left side wall 47. The size in the left and right direction of the second restriction part 61 is substantially equal to the size in the left and right direction of the first restriction part 60.

The second restriction part 61 includes a pair of first restriction walls 67 and a pair of second restriction walls 66. The first restriction walls 67 face with each other in the front and rear direction to have an interval therebetween. Each of the first restriction walls 67 extends in the up and down direction when viewed as a side view. The size of the first restriction wall 67 of the second restriction part 61 in the up and down direction is substantially equal to the size of the first restriction wall 65 of the first restriction part 60 in the up and down direction.

The pair of second restriction walls 66 face with each other in the up and down direction to have an interval therebetween. Each of the second restriction walls 66 extends linearly in the front and rear direction when viewed as a side view. The size of the second restriction wall 66 of the second restriction part 61 in the front and rear direction is smaller than the size of the second restriction wall 64 of the first restriction part 60 in the front and rear direction. Of the pair of second restriction walls 66, the upper second restriction wall 66 connects the upper edges of the pair of first restriction walls 67 in the front and rear direction, and the lower second restriction wall 66 connects the lower edges of the pair of first restriction walls 67 in the front and rear direction.

A virtual line L passing the central parts of the pair of first restriction walls 65 in the up and down direction and the central parts of the pair of second restriction walls 67 in the up and down direction overlaps with a developing roller shaft 9 when viewed in the left and right direction.

As shown in FIG. 3, the left side wall 47 is the left edge part of the first frame 40, and is disposed to face the right side wall to have an interval therebetween. The left side wall 47 is a plate-like member having a rectangular shape extending in the front and rear direction when viewed as a side view, and includes a developing chamber side wall 70 and a reservoir side wall 71.

The developing chamber side wall 70 is a rear part of the left side wall 47, and has a rectangular shape when viewed as a side view. Further, the developing chamber side wall 70 has a developing shaft insertion hole 72 and a supply shaft insertion hole 73.

The developing shaft insertion hole 72 is disposed to coincide with the developing shaft insertion hole 53 of the right side wall 48 when viewed in the left and right direction. The developing shaft insertion hole 72 has a shape of a letter "C" opened toward the rear side when viewed as a side view, and is recessed frontward from the center in the up and down direction of the rear edge of the developing chamber side wall 70. The supply shaft insertion hole 73 is disposed to coincide with the supply shaft insertion hole 54 of the right side wall 48 when viewed in the left and right direction. The supply shaft insertion hole 73 has a rectangular shape when viewed as a side view, and penetrates the developing chamber side wall 70 in the left and right direction.

The reservoir side wall 71 is the front part of the left side wall 47, and extends continuously to the front side from the front edge of the developing chamber side wall 70. The reservoir side wall 71 has a rectangular shape extending in the front and rear direction when viewed as a side view. Further, the reservoir side wall 71 has a toner filling opening 74.

The toner filling opening 74 is disposed in the front portion of the reservoir side wall 71. The toner filling opening 74 has a circular shape when viewed as a side view, and penetrates the reservoir side wall 71 in the left and right direction. As a result, the toner filling opening 74 communicates with a toner reservoir 7 (which is described later) in the left and right direction. A cap (not shown) is detachably attachable to the toner filling opening 74, and the toner filling opening 74 is closed by the cap.

Figure 8:
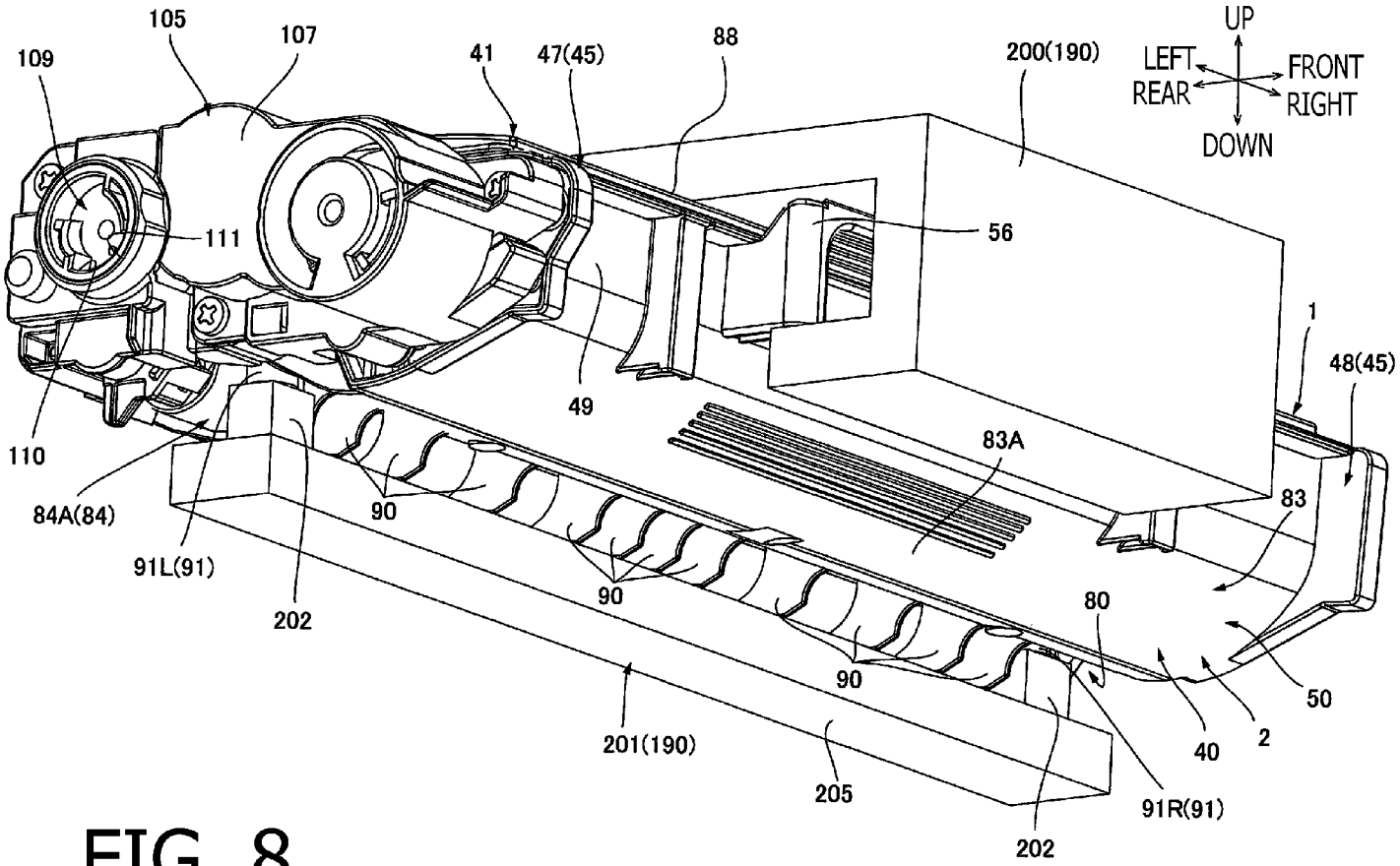
FIG. 8 illustrates a state where a pair of engagement bossed of the housing shown in FIG. 3 engages with a first restriction unit.

As shown in FIG. 5, the front wall 49 is the front edge part of the first frame 40, and is provided to extend between the front edges of the left side wall 47 and the right side wall 48. The front wall 49 is a plate-like member having a rectangular shape extending in the left and right direction when viewed as a front view. As shown in FIG. 3, the front wall 49 has a grip part 56. The grip part 56 is disposed at a central portion in the left and right direction on the front surface of the front wall 49. As shown in FIG. 8, the grip part 56 is formed in a letter "U" opened toward the lower side when viewed as a front view, and protrudes frontward from the front surface of the front wall 49.

The bottom wall 50 is the lower edge part of the first frame 40, and is provided to extend between the lower edges of the left side wall 47 and the right side wall 48. That is, the bottom wall 50 connects the pair of side walls 45 in the left and right direction. Further, the front edge of the bottom wall 50 is connected to the lower edge of the front wall 49. Specifically, the bottom wall 50 is formed to extend in the front and rear direction, and includes a bending part 83, an arc part 84 and a lip part 85, which are integrally provided.

The bending part 83 is the front part of the bottom wall 50. The bending part 83 is formed to bend such that the central portion thereof in the front and rear direction is oriented to the lower side, and includes a front bending part 83A and a rear bending part 83B. The front bending part 83A is the front part of the bending part 83, and is formed to be continuously bent toward the lower rear side from the lower edge of the front wall 49. The rear bending part 83B is the rear part of the bending part 83, and is formed to linearly and continuously extend to the upper rear side from the rear edge of the front bending part 83A when viewed as a side view.

The arc part 84 is disposed to adjoin the bending part 83 from the rear side. The arc part 84 has a shape of a semicircle opened to the upper side when viewed as a side view. The inner circumferential surface of the arc part 84 is formed to along the circumferential surface of the supply roller 5.

Specifically, the arc part 84 includes a front arc part 84A and a rear arc part 84B. The front arc part 84A is the front part of the arc part 84, and is formed to continuously extend to the lower side from the rear edge of the rear bending part 83B and then bend to the lower rear side. The rear arc part 84B is the rear part of the arc part 84, and is formed to continuously extend from the lower edge of the front arc part 84A and then bend to the upper rear side.

The lower surface of the rear bending part 83B and the lower surface of the front arc part 84A define a recessed part 80. The recessed part 80 has a wedge-shape when viewed as a side view, and is recessed to the upper rear side to be oriented to the inside of the housing 2.

The rip part 85 is disposed to adjoin the arc part 84 from the rear side, and is formed to continuously extend to the lower rear side from the rear edge of the rear arc part 84B.

Figure 4:
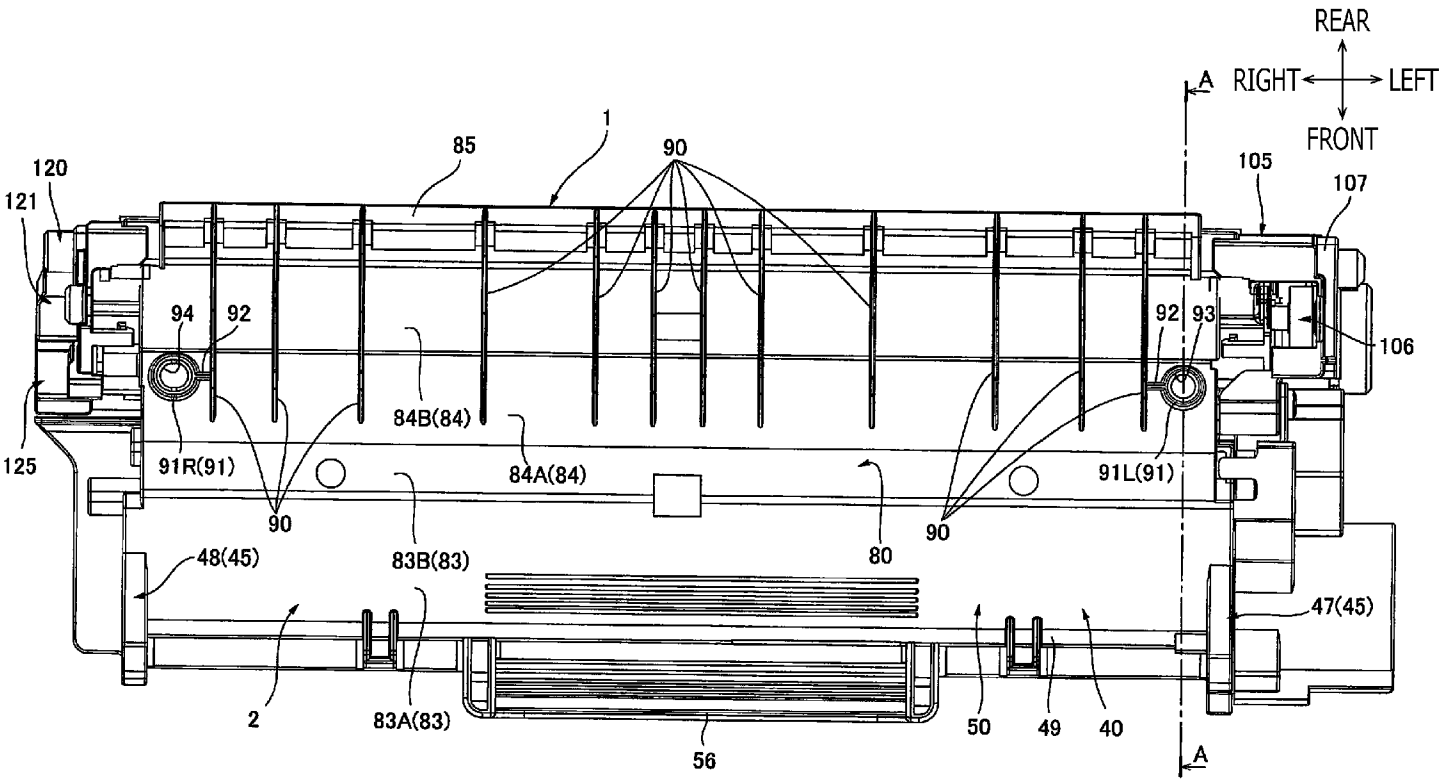
FIG. 4 is a bottom view of the developing cartridge shown in FIG. 1.

As shown in FIG. 4, the bottom wall 50 includes conveying ribs 90, a pair of engagement bosses 91 and connection ribs 92.

As shown in FIG. 5, the conveying ribs 90 are disposed on the lower surface of the bottom wall 50. Each conveying rib 90 has a plate-like shape, and protrudes to the lower side from the rear part of the lower surface of the bottom wall 50, i.e., the conveying rib 90 protrudes to the outside of the housing 2. Further, as shown in FIG. 4, each conveying rib 90 extends, in the front and rear direction, over a range from the front arc part 84A to the rip part 85 when viewed as a bottom view. The plurality of conveying ribs 90 are aligned in the left and right direction to have intervals therebetween. Specifically, twelve conveying ribs 90 are aligned.

As shown in FIG. 5, the lower edge of the conveying rib 90 includes a bending edge 90A, a first slanting edge 90B and a second slanting edge 90C. The bending edge 90A is the front part of the lower edge of the conveying rib 90, has a shape of a letter "C" when viewed as a side view, and is recessed to the upper rear side from the lower edge of the conveying rib 90. The bending part 90A is formed to be along the outer circumferential surface of the pinch roller 36.

The first slanting edge 90B extends to be inclined to the lower rear side continuously from the rear edge of the bending edge 90A. The second slanting edge 90C extends to be inclined to the upper rear side continuously from the rear edge of the first slanting edge 90B.

As shown in FIG. 10, the conveying ribs 90 configured as described above overlap with the passing port 33 of the drum frame 32 when viewed from the lower side in the state where the developing cartridge 1 is attached to the drum frame 32.

As shown in FIGS. 4 and 5, the pair of engagement bosses 91 are respectively disposed on the both sides of the plurality of conveying ribs 90 in the left and right direction to sandwich the plurality of conveying ribs 90 between the pair of engagement bosses 91, and are disposed to coincide with each other when viewed in the left and right direction.

The pair of engagement bosses 91 are respectively disposed at the both edge parts of the recesses part 80 in the left and right direction, and are formed to protrude downward from the lower surface of the rear bending part 83B. That is, the engagement bosses 91 protrude to the outside of the housing 2 from the rear bending part 83B along the direction in which the conveying ribs 90 protrude.

As shown in FIG. 5, the pair of engagement bosses 91 are disposed to entirely overlap with the conveying ribs 90 when viewed in the left and right direction, and the lower edges of the engagement bosses 91 are positioned on the upper side with respect to the lower edges of the conveying ribs 90. That is, the lower edges of the conveying ribs 90 are positioned on the opposite side of the lower surface of the rear bending part 83B with respect to the lower edges of the engagement bosses 91.

As shown in FIG. 4, of the pair of engagement bosses 91, the left engagement boss 91L is disposed on the left side of the leftmost one of the plurality of conveying ribs 90 to have an interval with respect to the leftmost one of the plurality of conveying ribs 90. As shown in FIGS. 4 and 5, the left engagement boss 91L has a cylindrical shape extending in the up and down direction, and protrudes downward from the left edge part of the lower surface of the rear bending part 83B.

An inner circumferential surface of the left engagement boss 91L is defined as a first hollow part 93. That is, the first hollow part 93 is recessed upward toward the inside of the housing 2 from the lower edge of the left engagement boss 91L. As shown in FIG. 4, the first hollow part 93 has a circular shape when viewed from the upper side. Further, as shown in FIG. 5, the rear bending part 83B is inclined, and therefore the first hollow part 93 has a shallow part 93A and a deep part 93B.

The shallow part 93A is a front part of the first hollow part 93, and the size of the shallow part 93A in the up and down direction is smaller than the inner diameter of the first hollow part 93. The deep part 93B is a rear part of the first hollow part 93, and the size of the deep part 93B in the up and down direction is larger than the inner diameter of the first hollow part 93.

As shown in FIG. 4, of the pair of engagement bosses 91, the right engagement boss 91R is disposed on the right side of the rightmost one of the plurality of conveying ribs 90 to have an interval with respect to the rightmost one of the plurality of conveying ribs 90. The right engagement boss 91R has an elliptical cylinder shape extending in the up and down direction, and protrudes downward from the right edge part of the lower surface of the rear bending part 83B.

An inner circumferential surface of the right engagement boss 91R is defined as a second hollow part 94. That is, the second hollow part 94 is recessed upward toward the inside of the housing 2 from the lower edge of the right engagement boss 91R. The second hollow part 94 has an elliptical shape extending in the left and right direction when viewed in the up and down direction. The short diameter of the second hollow part 94 is substantially equal to the inner diameter of the first hollow part 93, and the longer diameter of the second hollow part 94 is larger than the inner diameter of the first hollow part 93. As in the case of the first hollow part 93, the second hollow part 94 has a deep part whose size in the up and down direction is larger than the short diameter and a shallow part whose size in the up and down direction is smaller than the short diameter.

The connection rib 92 is disposed between the engagement boss 91 and the conveying rib 90 adjoining the engagement rib 91. Two connection ribs 92 are provided for the pair of engagement bosses 91, respectively. The connection rib 92 has a plate-like shape extending in the left and right direction and is formed to extend linearly when viewed as a bottom view. The connection rib 92 connects the inner edge of the engagement boss 91 in the left and right direction and the adjoining conveying rib 90. The upper edge of the connection rib 92 is connected to the lower surface of the rear bending part 83B.

(2) Second Frame

As shown in FIG. 3, the second frame 41 is an upper part of the housing 2, and covers the first frame 40 from the upper side. The second frame 41 is a plate-like member having a rectangular shape extending in the left and right direction when viewed as a plan view. The second frame 41 is integrally provided with an upper front wall 86 and an upper rear wall 87.

The upper front wall 86 is a front part of the second frame 41, and includes an expanded part 88 and a jaw part 89. As shown in FIG. 5, the expanded part 88 has a box-shape opened toward the lower side, and is formed to extend in the left and right direction (see FIG. 3).

The jaw part 89 is disposed on the both sides in the left and right direction and the front side with respect to the expanded part 88. That is, the jaw part 89 has shape of a letter "U" opened to the rear side when viewed as a plan view. The jaw part 89 is connected to the lower edge of the expanded part 88.

As shown in FIG. 5, the upper rear wall 87 is a rear part of the second frame 41, and includes a slanting wall 95 and a partition wall 96. The slanting wall 95 is a plate-like member having a rectangular shape extending in the left and right direction when viewed as a plan view, and is formed to extend to the rear side continuously from the lower edge of a rear wall of the expanded part 88 and to be bent and inclined to the lower rear side.

The partition wall 96 is disposed closely to the slanting wall 95 on the rear side of the slanting wall 95. The partition wall 96 is a plate-like member having a rectangular shape extending in the left and right direction when viewed as a rear view. Further, as shown in FIG. 5, a central part in the up and down direction of the front surface of the partition wall 96 is connected to the rear edge of the slanting wall 95.

(3) Housing

Figure 2:
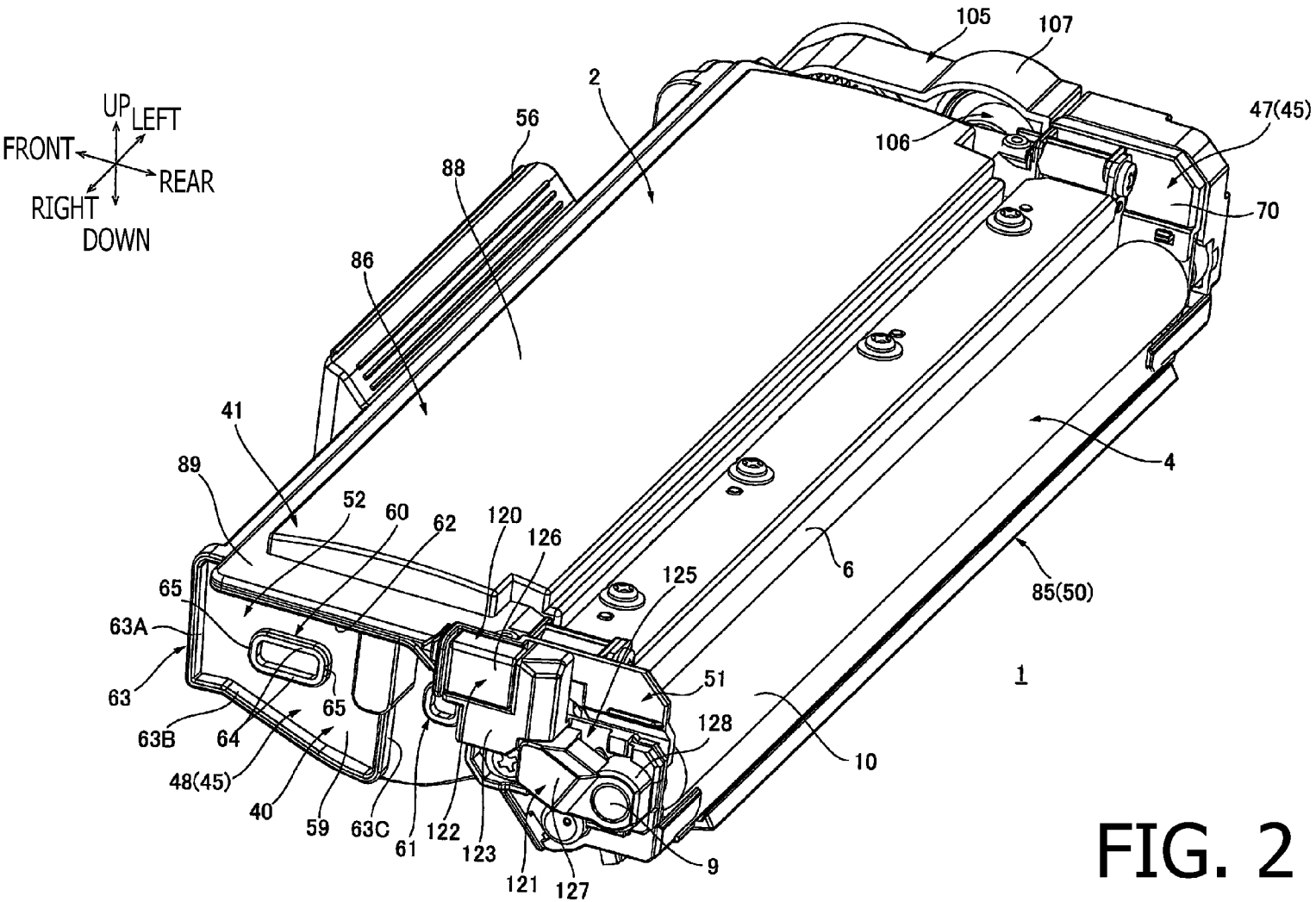
FIG. 2 is a perspective view of the developing cartridge shown in FIG. 1 viewed from the upper right side.

As shown in FIGS. 2, 3 and 5, the housing 2 is configured by combining the first frame 40 and the second frame 41 and by welding the upper edge of the reservoir side wall 71 of the left side wall 47, the welding part 62 of the reservoir side wall 52 of the right side wall and the upper edge of the front wall 49 to the jaw part 89 of the upper front wall 86.

With this configuration, as shown in FIG. 5, the second frame 41 is disposed on the upper side of the of the bottom wall 50 to be spaced from the bottom wall 50, and connects the upper edges of the pair of side walls 45 in the left and right direction. Further, the front arc part 84A of the bottom wall 50 extends from the front edge of the rear arc part 84B to the front side to approach the second frame 41. The rear bending part 83B extends continuously from the front edge of the front arc part 84A to the front side to depart from the second frame 41.

In the housing 2, the lower edge of the partition wall 96 and a connection part 98 of the bending part 83 and the arc part 84 are disposed to be spaced in a direction connecting the upper rear side and the lower front side. In a side cross sectional view of the housing 2, a rear space with respect to a virtual line L1 connecting the lower edge of the partition wall 96 and the upper edge of the connection part 98 is defined as a developing chamber 8, and a front space with respect to the virtual line L1 is defined as the toner reservoir 7 which stores the toner.

The lower edge of the partition wall 96, the upper edge of the connection part 98 and the left and right inner surfaces of the left side wall 47 and the right side wall 48 define a communication hole 99. That is, the housing 2 has the toner reservoir 7 and the developing chamber 8 which are disposed close to each other in the front and rear direction, and the communication hole 99 which communicates the toner reservoir 7 and the developing chamber 8 in the front and rear direction.

(4) Developing Chamber

Specifically, as shown in FIGS. 3 and 5, the developing chamber 8 is defined as by the developing chamber side wall 51 of the right side wall 48, the developing chamber side wall 70 of the left side wall 47 and the arc part 84 and the lip part 85 of the bottom wall 50.

As shown in FIG. 5, the developing cartridge 1 includes the developing roller 4, the supply roller 5 and the layer thickness limit blade 6 in the developing chamber 8.

The developing roller 4 is disposed in the lower edge part of the developing chamber 8, and is disposed on the upper side of the lip part 85 to be spaced from the lip part 85. The developing roller 4 includes the developing roller shaft 9 and a rubber roller 10.

The developing roller shaft 9 is made of metal, and has a circular column shape extending in the left and right direction. The rubber roller 10 has a cylindrical shape, and covers the developing roller shaft 9 such that the left and right ends of the developing roller shaft 9 are exposed.

The developing roller 4 is supported by the housing 2 such that the right end of the developing roller shaft 9 is rotatably supported by the developing chamber side wall 51 and the left end of the developing chamber 9 is rotatably supported by the developing chamber wall 70. With this configuration, the developing roller 4 is able to rotate with respect to the housing 2 about a center axis A1 of the developing roller shaft 9. Further, the right end of the developing roller shaft 9 protrudes rightward from the developing chamber side wall 51 via the developing shaft insertion hole 53, and the left end of the developing roller shaft 9 protrudes leftward from the developing chamber side wall 70 via the developing shaft insertion hole 72.

The supply roller 5 is disposed on the lower front side of the developing roller 4 in the developing chamber 8, and is housed in the arc part 84. The supply roller 5 includes a supply roller shaft 11 and a sponge roller 12.

The supply roller shaft 11 is made of metal, and has a circular column shape extending in the left and right direction. The sponge roller 12 has a cylindrical shape, and covers the supply roller shaft 11 such that left and right ends of the supply roller shaft 11 are exposed.

The supply roller 5 is supported by the housing 2 such that the right end of the supply roller shaft 11 is rotatably supported by the developing chamber side wall 51 and the left end of the supply roller shaft 11 is rotatably supported by the developing chamber side wall 70. With this configuration, the supply roller 5 is able to rotate, with respect to the housing 2, about a center axis A2 of the supply roller shaft 11. Further, the right end of the supply roller shaft 11 protrudes rightward via the supply shaft insertion hole 54 with respect to the developing chamber side wall 51, and the left end of the supply roller shaft 11 protrudes leftward via the supply shaft insertion hole 73 with respect to the developing chamber side wall 70.

The layer thickness limit blade 6 is disposed on the upper front side of the developing roller 4 in the developing chamber 8. As shown in FIG. 1, the layer thickness limit blade 6 is a plate-like member having a rectangular shape extending in the left and right direction when viewed as a rear view. Further, as shown in FIG. 5, the layer thickness limit blade 6 is supported by the rear surface of the partition wall 96 such that the lower edge of the layer thickness limit blade 6 contacts the front edge of the circumferential surface of the rubber roller 10.

(5) Toner Reservoir

Specifically, as shown in FIGS. 3 and 5, the toner reservoir 7 is defined by the reservoir side wall 52 of the right side wall 48, the reservoir side wall 71 of the left side wall 47, the bending part 83 of the bottom wall 50, the front wall 49 and the second frame 41.

As shown in FIG. 5, the developing cartridge 1 includes the agitator 3 in the toner reservoir 7. The agitator 3 includes an agitator shaft 13 and an agitating blade 14.

The agitator shaft 13 is made of resin, and includes a shaft body 100 and a blade support unit 101. The shaft body 100 has a circular column shape extending in the left and right direction. The blade support unit 101 has a shape of a letter "U", and an opened-side end thereof is connected to the shaft body 100. With this configuration, the blade support unit 101 extends, from the shaft body 100, outward in the radial direction of the shaft body 100.

The agitating blade 14 is formed of an elastic film member. The agitating blade 14 has a rectangular shape extending in the left and right direction. further, one edge of the agitating blade 14 is fixed to an outer part in the radial direction of the blade support unit 101. With this configuration, the agitating blade 14 is supported by the agitator shaft 13.

The agitator 3 is supported by the housing 2 such that the eight end of the shaft body 100 is rotatably supported by the reservoir side wall 52 and the left end of the shaft body 100 is rotatably supported by the reservoir side wall 71. With this configuration, the agitator 3 is able to rotate, with respect to the housing 2, about a center axis A3 of the shaft body 100. The left end of the shaft body 100 protrudes leftward from the reservoir side wall 71 of the left side wall 47.

(6) Relative Disposition of First Restriction Part, Second Restriction Part and Engagement Boss with Respect to Center Axis of Agitator As shown in FIG. 5, the first restriction part 60 is disposed on the front side with respect to the center axis A3 of the agitator 3, i.e., an opposite side of the developing chamber 8, when viewed in the left and right direction, and the second restriction part 61 is disposed between the developing chamber 8 and the center axis A3 of the agitator 3 in the front and rear direction.

Each of the pair of engagement bosses 91 is disposed on the front side with respect to the center axis A2 of the supply roller 5, i.e., on the toner reservoir 7 side, and is disposed between the developing chamber 8 and the center axis A3 of the agitator 3 in the front and rear direction. each of the pair of engagement bosses 91 is disposed closer to the center axis A1 of the developing roller 4 relative to the center axis A3 of the agitator 3. That is, an interval between the center axis A1 of the developing roller 4 and the shaft center of the engagement boss 91 in the front and rear direction is slightly smaller than an interval between the center axis A3 of the agitator 3 and the shaft center of the engagement boss 91.

(7) Drive Unit and Electrode Unit

As shown in FIGS. 1 and 2, the developing cartridge 1 includes a drive unit 105 and a power supply unit 120. As shown in FIG. 1, the drive unit 105 is configured to transmit a driving force to the developing roller 4, the supply roller 5 and the agitator 3. The drive unit 105 is disposed, closely to the left side wall 47, on the left side with respect to the left side wall 47, i.e., on an opposite side of the right side wall 48. The drive unit 105 includes a gear train 106 and a gear cover 107. The gear train 106 includes a developing coupling 109, a developing gear 108, a supply gear (not shown) and an agitator gear (not shown).

The developing gear 109 is disposed on the left surface of the developing chamber side wall 70 of the left side wall 47. The developing coupling 109 is supported by the developing chamber side wall 70 so as to be able to rotate about a rotation shaft (not shown). The developing coupling 109 has a circular column shape extending in the left and right direction. An outer circumferential surface of the right part of the developing coupling 109 has gear teeth over the entire circumferential surface thereof.

The developing coupling 109 has a coupling recession 110. The coupling recession 110 is disposed on the left end surface of the developing coupling 109. The coupling recession 110 has a circular shape when viewed as a side view, and is recessed rightward from the left end face of the developing coupling 109. Further, the coupling recession 110 is configured such that a main body coupling (not shown) is inserted to the coupling recession 110 to be unable to rotate relative to the coupling recession 110.

The developing gear 108 is attached to the left end of the developing roller shaft 9 so as to be unable to rotate relative to the developing roller shaft 9. Further, the developing gear 108 engages with the gear teeth of the developing coupling 109. The supply gear (not shown) is attached to the left end of the supply roller shaft 11 so as to be unable to rotate relative to the supply roller shaft 11. The supply gear (not shown) engages with the gear teeth of the developing coupling 109. The agitator gear (not shown) is attached to the left end of the shaft body 100 of the agitator 3 so as to be unable to rotate relative to the shaft body 100. The agitator gear (not shown) is coupled to the developing coupling 109 via an idle gear (not shown).

The gear cover 107 has a box-shape opened toward the right side, and has the size that the gear cover 107 is able to entirely cover the gear train 106. Further, the left wall of the gear cover 107 has an exposing hole 111. The exposing hole 111 has a circular shape when viewed as a side view, and penetrates through the left wall of the gear cover 107 in the left and right direction.

The gear cover 107 is screwed to the left surface of the left side wall 47 so as to let the coupling recession 110 of the developing coupling 109 be exposed via the exposing hole 111 and to cover entirely the gear train 106.

As shown in FIG. 2, the power supply unit 120 is disposed, on the right side of the right side wall 48, closely to the right side wall 48. The power supply unit 120 includes a supply electrode 122, an insulating member 125 and a developing electrode 121.

The supply electrode 122 is made of conductive resign material, and is supported by the right surface of the developing chamber side wall 51 of the right side wall 48. Although not shown in the drawings, the supply electrode 122 is electrically connected to the right end of the supply roller 11. Further, the supply electrode 122 includes a supply side contact 126. The supply side contact 126 is configured to be electrically connected to a main body side supply electrode (not shown) which the main body casing 16 includes. The supply side contact 126 has a shape of a rectangular cylinder of which right end is closed and which extends in the left and right direction.

The insulating member 125 is made of insulating resin material, and is fixed to the developing chamber side wall 51 on the right side of the supply electrode 122. The insulating member 125 includes an insulating part 123. The insulating part 123 is disposed, on the rear side of the supply side contact 126, closely to the supply side contact 126. When viewed as a side view, the insulating part 123 has a shape of an L-shaped rectangular cylinder of which right end is closed and which extends in the left and right direction.

The developing electrode 121 is made of conductive material, and is supported by the insulating part 125 on the right side of the insulating part 125. The developing electrode 121 includes a developing side contact 127 and a developing shaft collar part 128.

The developing side contact 127 is configured to be electrically connected to a main body side developing electrode (not shown) which the main body casing 16 includes, and is disposed on the lower rear side of the insulating part 123. The developing side contact 127 has a shape of a rectangular cylinder of which right end is closed and which extends in the left and right direction.

The developing shaft collar part 128 is disposed on the rear side of the developing side contact 127. The developing shaft collar 128 has a cylindrical shape extending in the left and right direction, and rotatably receives the right end of the developing roller shaft 9.

4. Assembling Operation of Developing Cartridge

Figure 9:
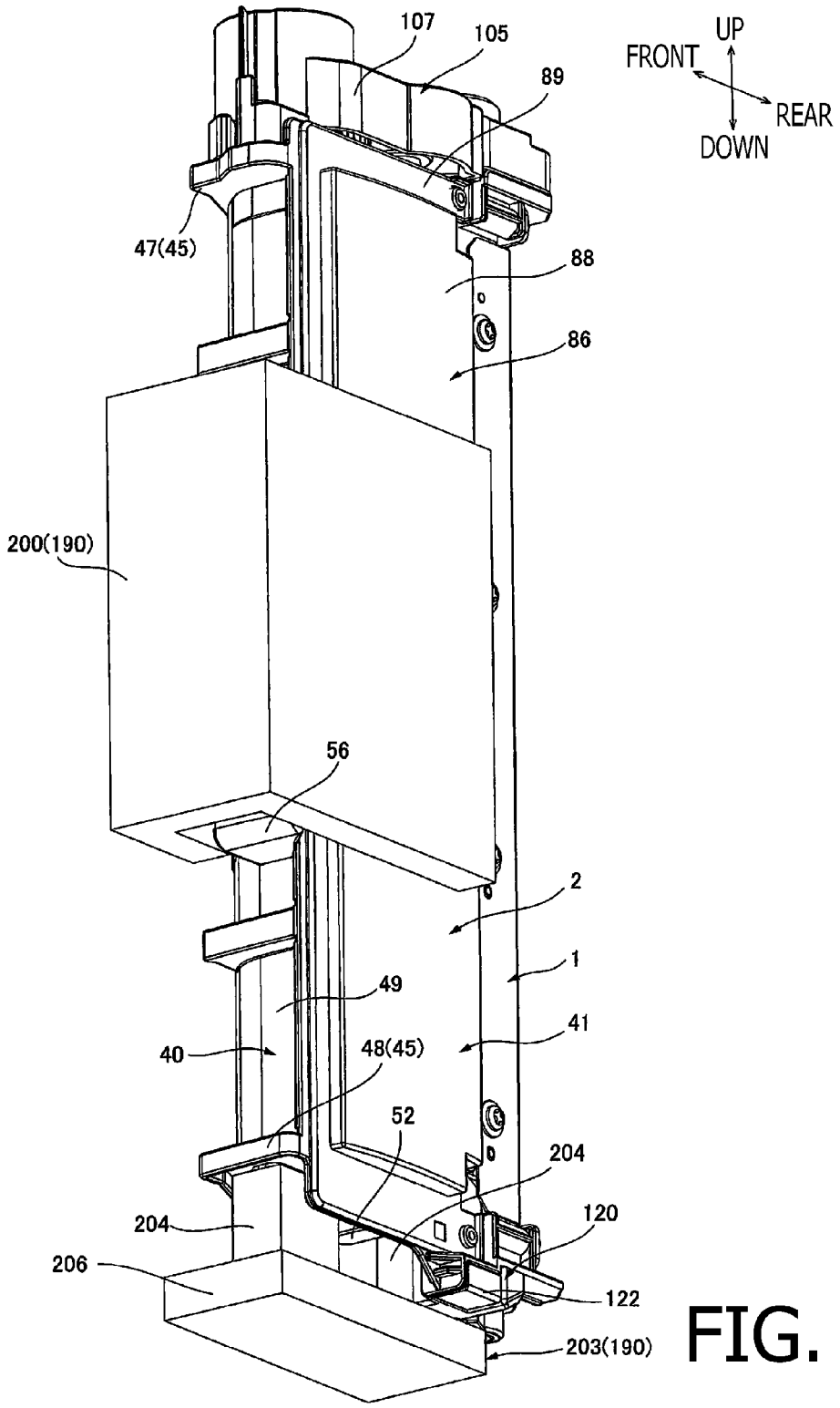
FIG. 9 illustrates a state where the first restriction part and a second restriction part of the housing shown in FIG. 8 engage with a second restriction unit.

Hereafter, an assembling operation for the developing cartridge 1 is explained with reference to FIGS. 8 and 9. Although FIGS. 8 and 9 illustrates the state where the supply roller 5, the developing roller 4, the power supply unit 120 and the drive unit 105 are attached to the housing 2 for the sake of convenience, in an assembling process of the developing cartridge 1, the supply roller 5, the developing roller 4, the power supply unit 120 and the drive unit 105 are sequentially attached to the housing 2 as described later.

Although an assembling method of the developing cartridge is not particularly limited, the developing cartridge 1 is assembled, for example, by an automatic assembling line 190. When the developing cartridge 1 is assembled by the automatic assembling line 190, the assembling operation which is described later is implemented by an assembling robot.

The automatic assembling line 190 includes a first restriction unit 201, a second restriction unit 203 and an arm 200.

As shown in FIG. 8, the first restriction unit 201 includes a first support plate 205 and a pair of first pillar parts 202. The first support plate 205 is a plate-like member having a rectangular shape extending in the left and right direction when viewed as a plan view. The pair of first pillar parts 202 are provided respectively for the pair of engagement bosses 91, and are disposed on the upper surface of the first support plate 205. The pair of first pillar parts 202 have rectangular column shapes extending in the up and down direction, and are formed to extend upward from the both end parts of the upper surface of the first support plate 205 in the left and right direction. Further, although not shown in the drawings, each of the first pillar parts 202 has a projection. The projection (not shown) has a circular column shape extending in the up and down direction, and is formed to extend upward from a central part of the upper surface of the first pillar part 202 when viewed as a plan view. The outer diameter of the projection (not shown) is substantially equal to the inner diameter of the first hollow part 93.

As shown in FIG. 9, the second restriction unit 203 includes a second support plate 206 and a pair of second pillar parts 204. The second support plate 206 is a plate-like member having a rectangular shape extending in the front and rear direction. The pair of second pillar parts 204 are provided respectively for the first restriction part 60 and the second restriction part 61, and are disposed on the upper surface of the second support plate 206. The pair of second pillar parts 204 have rectangular column shapes extending in the up and down direction, and are formed to extend upward from the both end parts of the upper surface of the second support plate 206 in the left and right direction. Further, although not shown in the drawings, each of the second pillar parts 204 has a projection. The projection (not shown) circular column shape extending in the up and down direction, and is formed to extend upward from a central part of the upper surface of the second pillar parts 204 when viewed as a plan view. The outer size of the projection (not shown) is substantially equal to the inner size of the second restriction part 61.

As shown in FIG. 8, the arm 200 has a J-shape when viewed as a side view, and is formed to extend in the left and right direction. The arm 200 is configured to sandwich the lower edge of the grip part 56 and the upper edge of the expanded part 88 by advancing from the front side to the rear side with respect to the developing cartridge 1. With this configuration, the arm 200 is able to hold the developing cartridge 1.

As shown in FIGS. 3, 4 and 8, in order to assemble the developing cartridge 1, first, a worker disposed the housing 2 on the upper side of the first restriction unit 201 such that the first hollow part 93 of the left engagement boss 91L receives the projection of the left first pillar part 202 and the second hollow part 94 of the right engagement boss 91R receives the projection of the right first pillar part 202. As a result, the relative movement of the housing 2 in the horizontal direction with respect to the first restriction unit 201 is restricted.

Next, as shown in FIGS. 3 and 5, the supply roller 5 is attached to the housing 2 such that the left and right ends of the supply roller 11 are respectively inserted into the corresponding ones of the supply shaft insertion holes 54 and 73. Then, the developing roller 4 is attached to the housing 2 such that the both ends in the left and right direction of the developing roller shaft 9 are respectively inserted into the corresponding ones of the developing shaft insertion holes 53 and 72.

Next, as shown in FIGS. 3 and 6, the supply electrode 122, the insulating member 125 and the developing electrode 121 are sequentially attached to the developing chamber side wall 51 of the right wall 48 from the right side.

Thereafter, as shown in FIG. 8, the arm 200 approaches the housing 2 from the front side, and engages with the housing 2 such that the arm 200 sandwiches the lower edge of the grip part 56 and the upper edge of the expanded part 88. As a result, the housing 2 is held by the arm 200. The arm 200 lifts upward the housing 2, and releases the engagement of the pair of engagement bosses 91 and the pair of first pillar parts 202.

Next, the arm 200 rotates the housing 2 by approximately 90 degrees in the clockwise direction when viewed as a plan view in the state of holding the housing 2 so that the longer direction of the housing 2 is disposed to be along the up and down direction. as a result, the right side wall 48 of the housing 2 is positioned on the lower side and the left side wall 47 of the housing 2 is positioned on the upper side.

Then, as shown in FIGS. 6 and 9, the housing 2 is disposed on the upper side of the second restriction unit 203 such that the second restriction part 61 receives the projection of the front second pillar part 204 and the second restriction part 61 receives the projection of the rear second pillar part 204. As a result, movement of the housing 2 in the horizontal direction with respect to the second restriction unit 203 is restricted.

Next, a toner filling device (not shown) fills the toner into the toner reservoir 7, along the up and down direction, from the toner filling opening 74, and thereafter the tone filling opening 74 is closed with a cap (not shown).

Thereafter, as shown in FIGS. 1 and 9, the gear train 106 and the gear cover 107 are sequentially attached to the left side wall 47 from the upper side.

Thus, the assembling work for the developing cartridge 1 is finished.

5. Advantageous Effects (1) as shown in FIG. 6, the first restriction part 60 and the second restriction part 61 are disposed, on the right side of the right side wall, closely to the right side wall 48, i.e., opposite to the left side wall 47. Therefore, as shown in FIG. 9, during assembling of the developing cartridge 1, the pair of first restriction wall 65 and the pair of first restriction walls 67 can be respectively engaged with the second restriction unit 203, and therefore movement of the housing 2 can be restricted.

As a result, since the developing cartridge 1 can be assembled in the state where movement of the housing 2 is restricted, the assembling work for the developing cartridge 1 can be stabilized and smoothed.

In particular, since the drive unit 105 is disposed, on the left side of the left side wall 47, closely to the left side wall 47, the drive unit 105 can be securely attached to the housing 2 in the state where the first restriction part 60 and the second restriction part 61 are engaged with the second restriction unit 203. Therefore, the assembling work for the drive unit 105 can be smoothed.

(2) As shown in FIG. 6, each of the first restriction part 60 and the second restriction part 61 defines a ringed shape when viewed in the left and right direction. Therefore, each of the first restriction part 60 and the second restriction part 61 can be securely engaged with the pair of second pillar parts 204, and as a result movement of the housing 2 can be securely restricted.

(3) As shown in FIG. 3, the left side wall 47 has the toner filling opening 74. Therefore, as shown in FIG. 9, the toner can be filled into the inside of the housing 2 via the toner filling opening 74 in the state where the first restriction part 60 and the second restriction part 61 are engaged with the pair of second pillar parts 204. As a result, the toner filling work for the housing 2 can be smoothed.

(4) As shown in FIG. 6, the first restriction part 60 and the second restriction part 61 are disposed on the reservoir side wall 52 constituting the toner reservoir 7. Therefore, the first restriction part 60 and the second restriction part 61 can be easily disposed. In particular, as shown in FIG. 9, when the first restriction part 60 and the second restriction part 61 engage the pair of second pillar parts 204, movement of the toner reservoir 7 of the housing 2 can be securely restricted. As a result, when the toner is filled into the inside of the housing 2 via the toner filling opening 74, the housing 2 can be stably supported.

(5) As shown in FIG. 5, the second restriction part 61 is disposed between the developing chamber 8 and the center axis A3 of the agitator 3 when viewed in the left and right direction. Therefore, be causing the second restriction part 61 to engage with the second pillar part 204, a relatively heavy part of the developing cartridge 1 can be securely supported. As a result, the developing cartridge 1 can be stably supported in a well-balanced manner.

(6) As shown in FIG. 5, the first restriction part 60 is disposed on the front side with respect to the center axis A3 of the agitator 3, and the second restriction part 61 is disposed on the rear side with respect the center axis A3 of the agitator 3, therefore, by causing the first restriction part 60 and the second restriction part 61 engage with the pair of second pillar parts 204, movement of the developing cartridge 1 is securely prevented.

(7) As shown in FIG. 6, the first restriction part 60 is surrounded by the welding part 62 and the reinforcement rib 63 when viewed in the left and right direction. Therefore, the first restriction part 60 is protected by the welding part 62 and the reinforcement rib 63. As a result, it becomes possible to prevent the first restriction part 60 from being damaged, for example, when a person accidentally lets the developing cartridge 1 drop down.

(8) As shown in FIG. 7, the right edge of the reinforcement rib 63 is positioned on the right side with respect to the right edge of the first restriction wall 65. Therefore, when a person accidentally lets the developing cartridge 1 drop down, it is possible to prevent the right edge of the reinforcement rib 63 from crashing against, for example, a floor, and thereby to prevent the right edge of the first restriction wall 65 from crashing against, for example, a floor. As a result, it is possible to securely prevent the first restriction part 60 from being damaged.

(9) As shown in FIG. 5, the pair of engagement bosses 91 protrude downward from the lower surface of the rear bending part 83B of the bottom wall 50. That is, the engagement bosses 91 and the conveying ribs 90 protrude together to the lower side from the bottom wall 50.

Therefore, as shown in FIG. 8, during the assembling of the developing cartridge 1, the pair of engagement bosses 91 can be engaged with the pair of first pillar parts 202 of the first restriction unit 201. As a result, movement of the housing 2 in the horizontal direction with respect to the first restriction unit can be restricted.

Furthermore, as shown in FIG. 5, the pair of engagement bosses 91 are disposed on the front side, i.e., on the toner reservoir 7 side, with respect to the center axis A2 of the supply roller 5. Therefore, when the pair of engagement bosses 91 are engaged with the pair of first pillar parts 202, the developing cartridge 1 can be supported in a well-balanced manner. As a result, the assembling work for the developing cartridge 1 can be stabilized and smoothed.

Furthermore, the lower edge of the conveying rib 90 is positioned on the lower side with respect to the lower edge of the engagement boss 91, i.e., on an opposite side of the lower surface of the bottom wall 50 with respect to the lower edge of the engagement boss 91. Therefore, as shown in FIG. 10, when the conveying ribs 90 guide conveying of the sheet of paper S, the pair of engagement bosses 91 can be prevented from contacting the sheet of paper S.

(10) As shown in FIG. 5, each of the pair of engagement bosses 91 is disposed between the developing chamber 8 and the center axis A3 of the agitator 3 in the front and rear direction. Therefore, as shown in FIG. 8, by engaging the pair of engagement bosses 91 with the pair of first pillar parts 202, a relatively heavy part of the developing cartridge 1 can be securely supported. As a result, the developing cartridge 1 can be securely supported.

(11) As shown in FIG. 5, the pair of engagement bosses 91 are disposed closer to the center axis A1 of the developing roller 4 than the center axis A3 of the agitator 3. Therefore, as shown in FIG. 8, by engaging the pair of engagement bosses with the pair of first pillar parts 202, the relatively heavy part of the developing cartridge 1 can be supported more securely.

(12) As shown in FIG. 5, the pair of engagement bosses 91 are disposed in the recessed part 80 which is recessed upward to the inside of the housing 2. Therefore, the protruding amount of the engagement boss 91 can be increased while suppressing increase in size of the developing cartridge 1 in the up and down direction. As a result, reliable engagement between the engagement boss 91 and an external member can be secured while suppressing increase in size of the developing cartridge.

(13) As shown in FIG. 5, the bottom wall 50 has the front arc part 83A and the rear bending part 83B, and the outer surface of the front arc part 83A and the outer surface of the rear bending part 83B constitute the recessed part 80. Since the engagement bosses 91 are disposed on the outer surface of the rear bending part 83B which is on the toner reservoir 7 side with respect to the front arc part 84A, the engagement bosses 91 can be securely disposed on the toner reservoir 7 side with respect to the center axis A2 of the supply roller 5.

(14) Since, as shown in FIG. 4, the plurality of conveying ribs 90 are aligned in parallel to have intervals therebetween in the left and right direction, conveying of the sheet of paper S can be securely guided.

Furthermore, the conveying ribs 90 disposed at both ends in the left and right direction and the pair of engagement bosses 91 are connected by the connection ribs 92, respectively. Therefore, the conveying rib 90 and the engagement boss 91 which are connected together can be securely reinforced.

(15) As shown in FIG. 5, each of the pair of engagement bosses 90 is disposed to entirely overlap with the conveying rib 90 when viewed in the left and right direction, Therefore, as shown in FIG. 10, when the conveying ribs 90 guide conveying of the sheet of paper S, the pair of engagement bosses 91 can be securely prevented from contacting the sheet of paper S. as a result, more smooth conveying of the sheet of paper S can be secured.

(16) As shown in FIG. 4, the left engagement boss 91L has the first hollow part 93, and the right engagement boss 91R has the second hollow part 94. Therefore, since the first hollow part 93 and the second hollow part 94 respectively receive the projections (not shown) of the pair of first pillar parts 202 as shown in FIG. 8, the pair f engagement bosses 91 and the pair of first pillar parts 202 can be securely engaged with each other.

Furthermore, since, as shown in FIG. 4. the second hollow part 94 has an elliptical shape elongated in the left and right direction when viewed from the lower side, shift in the left and right direction is accepted when the pair of engagement bosses 91 are engaged with the pair of first pillar parts 202.

(17) As shown in FIG. 5, the first hollow part 93 has the deep part whose size in the up and down direction is larger than the inner diameter of the first hollow part 93. Therefore, the first hollow part 93 is able to securely received the projection of the left first pillar part 202.

6. Variation (1) As shown in FIG. 9, in the above described embodiment, movement of the housing 2 is restricted by the first restriction part 60 and the second restriction part 61; however, the embodiment is not limited to such a configuration. Movement of the housing 2 may also be restricted by the first restriction part 60 and the second restriction part 61 when toner is filled again into the used developing cartridge 1.

In this case, the drive unit 105 is removed from the second wall 47 after the housing 2 is disposed such that the longer direction of the housing 2 is along the up and down direction, and the first restriction part 60 and the second restriction part 61 are engaged with the pair of second pillar parts 204. Then, the cap (not shown) is removed from the toner filling opening 74, and the toner is filled into the toner reservoir 7 via the toner filling opening 74.

(2) As shown in FIGS. 8 and 9, in the above described embodiment, the developing cartridge 1 is assembled on the automatic assembling line 190; however, the embodiment is not limited to such a configuration. The developing cartridge 1 may be assembled manually using the first restriction unit 201 and the second restriction unit 202.

(3) In the above described embodiment, the developing cartridge 1 is configured to be detachably attachable to the drum frame 32 of the drum cartridge 25; however, the embodiment is not limited to such a configuration. For example, the developing cartridge 1 may be formed integrally with the drum cartridge 25. In this case, the process cartridge 17 in which the developing cartridge 1 and the drum cartridge 25 are integrally provided corresponds to an example of a developing cartridge.

(4) In pace of the above described developing roller 4, for example, a brush roller, a magnetic roller or the like may be employed.

(5) The above described first restriction part 60 may be formed as a separate member provided separately from the right side wall 48 of the housing 2, and may be attached to the reservoir side wall 52 of the right side wall 48. In the first restriction part 60, the pair of second restriction walls 64 may not be provided.

(6) The above described second restriction part 61 may be formed as a separate member provided separately from the right side wall 48 of the housing 2, and may be attached to the reservoir side wall 52 of the right side wall 48. In the second restriction part 61, the pair of second restriction walls 66 may not be provided. With this configuration, the same advantageous effects of the above described embodiment can also be achieved.

(7) The above described pair of engagement bosses 91 may be formed as separate members which are separately provided from the bottom wall 50 of the housing 2, and may be formed to be attached to the bottom wall 50.

(8) The above described pair of second restriction walls 64 may be formed as separate members which are provided separately from the right side wall of the housing 2, and may be attached to the reservoir side wall 52 of the right side wall 52.

(9) The shapes of the first hollow part 93 and the second hollow part 94 are not limited to the above described circular shape and the elliptical shape, but may be a polygonal shape.

It is understood that the above described embodiment and the variations can be appropriately combined.

What is claimed is:

1. A developing cartridge, comprising:

a housing configured to store developer;

a developing roller rotatable about a first axis extending in a first direction;

an agitating member rotatable about a second axis extending in the first direction;

a drive mechanism configured to transmit a driving force to the developing roller; and a restriction part configured to restrict movement of the housing when the restriction part engages with an external member, wherein the housing comprises:

a first side wall; and a second side wall disposed to face the first side wall while being spaced from the first side wail in the first direction, wherein the drive mechanism is disposed to the second side wall, wherein the restriction part includes:

a first restriction portion extending from the first side wail in the first direction; and a second restriction portion extending from the first side wall in the first direction, the second restriction portion being arranged between the first axis and the second axis in a second direction and the second direction connecting the first axis and the second axis, and wherein the first restriction portion is disposed on an opposite side of the second restriction portion with respect to the second axis in the second direction.

2. The developing cartridge according to claim 1, wherein the first restriction portion and the second restriction portion define a ring-like shape when viewed in the first direction.

3. The developing cartridge according to claim 1, wherein the second side wall has a developer filling opening through which the developer is filled into the housing.

4. The developing cartridge according to claim 1, wherein the housing comprises:

a first container unit containing the developing roller; and a second container unit containing the developer and the agitating member, the second container unit being disposed adjacent to the first container unit on one side in the second direction, wherein the first side wall comprises:

a first part configuring the first container unit; and a second part configuring the second container unit, and wherein the first restriction portion and the second restriction portion are disposed to the second part.

5. The developing cartridge according to claim 1, wherein the housing comprises:

a first frame which comprises the first side wall and the second side wall; and a second frame welded to the first frame, wherein the first side wall comprises:

a welding part protruding from one surface of the first side wall and configured to be welded to the second frame; and a reinforcement rib disposed on one surface of the first side wall and to reinforce the first side wall, wherein the welding part and the reinforce rib are disposed to surround the first restriction portion when viewed in the first direction.

6. The developing cartridge according to claim 1 wherein:

the first side wall comprises a reinforcement rib disposed on one surface of the first side wall; and an outer edge of the reinforcement rib in the first direction is positioned on an outside in the first direction with respect to an outer edge of the first restriction portion and the second restriction portion in the first direction.

* * * * *